United States Patent [19]

Hashizume

[11] Patent Number: 4,640,111

[45] Date of Patent: Feb. 3, 1987

[54] LOCKING DEVICE FOR A DOOR ON SAFE OR THE LIKE APPARATUS

[75] Inventor: Masao Hashizume, Hiroshima, Japan

[73] Assignee: Kumahira Safe Co., Inc., Hiroshima, Japan

[21] Appl. No.: 587,251

[22] Filed: Mar. 7, 1984

[30] Foreign Application Priority Data

Nov. 21, 1983 [JP] Japan ..... 58-217908

[51] Int. Cl.[4] ..... E05B 37/00

[52] U.S. Cl. ..... 70/314; 70/322

[58] Field of Search ..... 70/314, 213, 321, 322

[56] References Cited

U.S. PATENT DOCUMENTS

| | | | |
|---|---|---|---|
| 724,207 | 3/1903 | Roche | 70/314 |
| 1,054,769 | 3/1913 | Hobsa | 70/314 |
| 1,320,139 | 10/1918 | Hanflig | 70/314 |
| 1,813,473 | 7/1931 | Walker | 70/314 |
| 2,988,911 | 6/1961 | Carter | 70/314 |
| 3,529,454 | 9/1970 | Fish | 70/314 |
| 4,011,742 | 3/1977 | Klein | 70/314 |

*Primary Examiner*—Robert L. Wolfe

*Attorney, Agent, or Firm*—Cushman, Darby & Cushman

[57] ABSTRACT

An improved locking device for a door turnably mounted on a safe or the like apparatus of the type including a numbering lock and a movable plate adapted to carry out locking activity is disclosed. An engagement recess is formed on the lower edge of a movable plate so that a locking bar comes in locking engagement to the recess. The movable plate is operatively connected to a lever plate by way of a slidable pin and a coil spring and the lever plate in turn is operatively connected to an actuating plate adapted to move within a certain extent together with a ratch member turnably supported by the side of the actuating plate under the influence of resilient force of a leaf spring. To allow the ratch member to be projected into the lock case a part of the latter is cut out and a plurality of tumblers are housed in the lock case. One of the tumblers is fitted with an engagement pin to which the ratch member comes in engagement as the actuating plate is displaced in the direction of unlocking. In general the movable plate is movably disposed along the inner wall of the door in the horizontal posture.

16 Claims, 4 Drawing Figures

LOCKING DEVICE FOR A DOOR ON SAFE OR THE LIKE APPARATUS

BACKGROUND OF THE INVENTION

1. Field of the Invention

The present invention relates to a locking device for a door turnably mounted on a safe or the like apparatus. More particularly to improvement of a locking device of the type including a numbering lock and a movable plate adapted to carry out locking activity, wherein the movable plate is fitted with a locking bar at its force end, from which at least one locking rod extends to be inserted into corresponding hole on the safe or the like apparatus.

2. Description of the Prior Art

As is well known, a safe or the like apparatus is usually equipped with a so-called numbering lock. Locking of the numbering lock is normally effected by way of the steps of closing a door, causing locking rods fixedly secured to a movable plate to enter corresponding holes on the housing of the safe and then rotating tumblers designed to determine unlocking numbers for the numbering lock by rotating a dial by a number of revolutions more than specified one. However, it has been found with respect to the conventional locking device of the type including a numbering lock that complete closing and locking operations often fail to be carried out for a safe in an emergency situation with merely closure of the door taking place. Further, another problem is that the numbering lock may be kept unlocked after daily locking operation is completed, because an operator unintentionally forgets to rotate a dial by a number of revolutions more than specified one. This means that the safe does not guarantee completely safe locking function.

SUMMARY OF THE INVENTION

Thus, the present invention has been made with the foregoing problems in mind and its object resides in providing an improved locking device for door turnably mounted on a safe or the like apparatus of the type including a numbering lock and a movable plate adapted to carry out locking activity wherein it is assured that the movable plate and the locking bar are simultaneously actuated by operating a handle while a plurality of tumblers designed to determine unlocking numbers for the numbering lock are automatically rotated so that the latter is brought in the locked state under any operative conditions.

Other object of the present invention is to provide an improved locking device which is simple in structure and can be manufactured at an inexpensive cost.

To accomplish the above objects there is proposed in accordance with the present invention a locking device for a door turnably mounted on a safe or the like apparatus of the type including a numbering lock and a movable plate adapted to carry out locking activity, wherein the movable plate is fitted with a locking bar at its fore end from which at least one locking rod extends to be inserted into a corresponding hole on the safe or the like apparatus, the movable plate being formed with an engagement recess on the lower edge thereof to which a locking bar is adapted to come in engagement when locking is effected, that the movable plate operatively connected to a lever plate by way of a slidable pin and a coil spring compressively disposed on the latter. The lever plate in turn is operatively connected to an actuating plate adapted to move within a certain extent as defined by elongated holes together with a ratch member turnably supported by the side of the actuating plate and that a part of the lock case is cut out for allowing the ratch member to be projected thereinto and one of tumblers designed to determine unlocking numbers for the numbering lock is provided with an engagement means in the form of a pin to which the ratch member comes in abutment.

In the locking device of the invention the movable place constituting one of the most important components may be disposed in any direction along the inner wall of the door but in general it is disposed in the horizontal posture. At the one end part of the movable plate a locking bar is secured to the latter, whereas at the other end part of the same a handle is turnably provided for operating the locking device.

The lever plate is supported on a support rod at the middle part thereof so as to turn about it. To define an extent of movement of both the movable plate and the actuating plate a pair of elongated holes are formed on each of them. The engagement means fitted to the lower part of one of the tumblers is preferably a pin which projects on it.

To inhibit excessive turning movement of the ratch member a pin is provided on the actuating plate and the ratch member is adapted to turn in the direction toward the lever plate under the influence of resilient force of a leaf spring.

Other objects, features and advantages of the present invention will become more clearly apparent from reading of the following specification which has been prepared in conjunction with the accompanying drawings.

BRIEF DESCRIPTION OF THE DRAWINGS

The accompanying drawings will be briefly described below.

DETAILED DESCRIPTION OF THE PREFERRED EMBODIMENT

Figure 1:
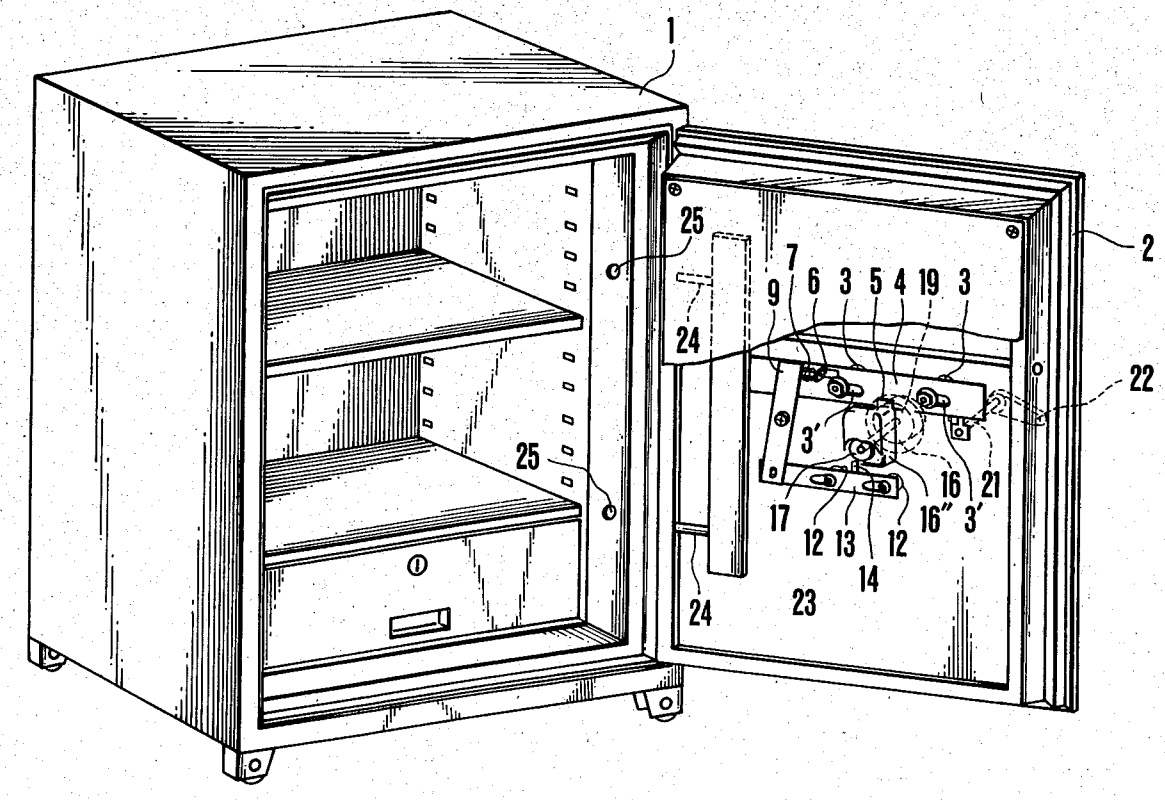
FIG. 1 is a perspective view of a safe with a door turnably mounted thereon, shown in the opened state, wherein a locking device according to a preferred embodiment is fitted to the inside wall of the door.

Now, the present invention will be described in a greater detail hereunder with reference to the accompanying drawings which illustrate a preferred embodiment of the invention.

A safe 1 has a door 2 turnably supported thereon to which inner wall a pair of support rods 3 are fixedly secured. Each of the support rods 3 is fitted through an elongated guide hole 3' on a movable plate 4 so that the latter is displaced leftward or rightward within an extent which is defined by the length of the elongated guide holes 3'. Further, the movable plate 4 is formed with an engagement recess 5 at a predetermined position located on the lower edge and moreover it has a L-shaped bracket 6 fixedly attached to the upper edge thereof. A pin 7 is inserted through a hole on the bracket 6 so that it slides therethrough.

Figure 4:
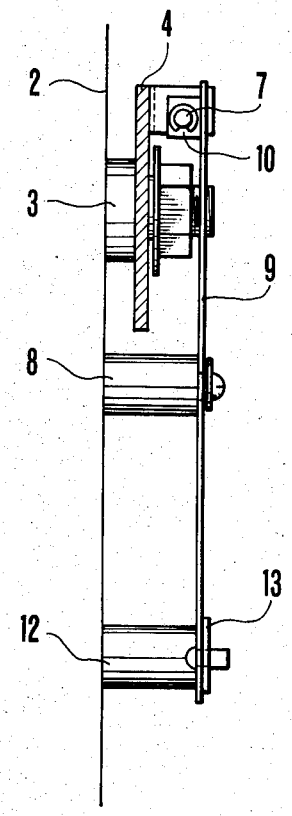
FIG. 4 is another vertical sectional view of the locking device taken in line II—II in FIG. 2.

A lever plate 9 is turnably supported on a support rod 8 (shown in FIG. 4) fixedly secured to the inner wall of the door 2 and it has a L-shaped bracket 10 (shown in FIG. 2) fixedly attached to the upper end part thereof so that the pin 7 is slidably fitted through a hole on said bracket 10. A coil spring 11 is compressively disposed on the pin 7 between both the L-shaped brackets 6 and 10.

Figure 2:
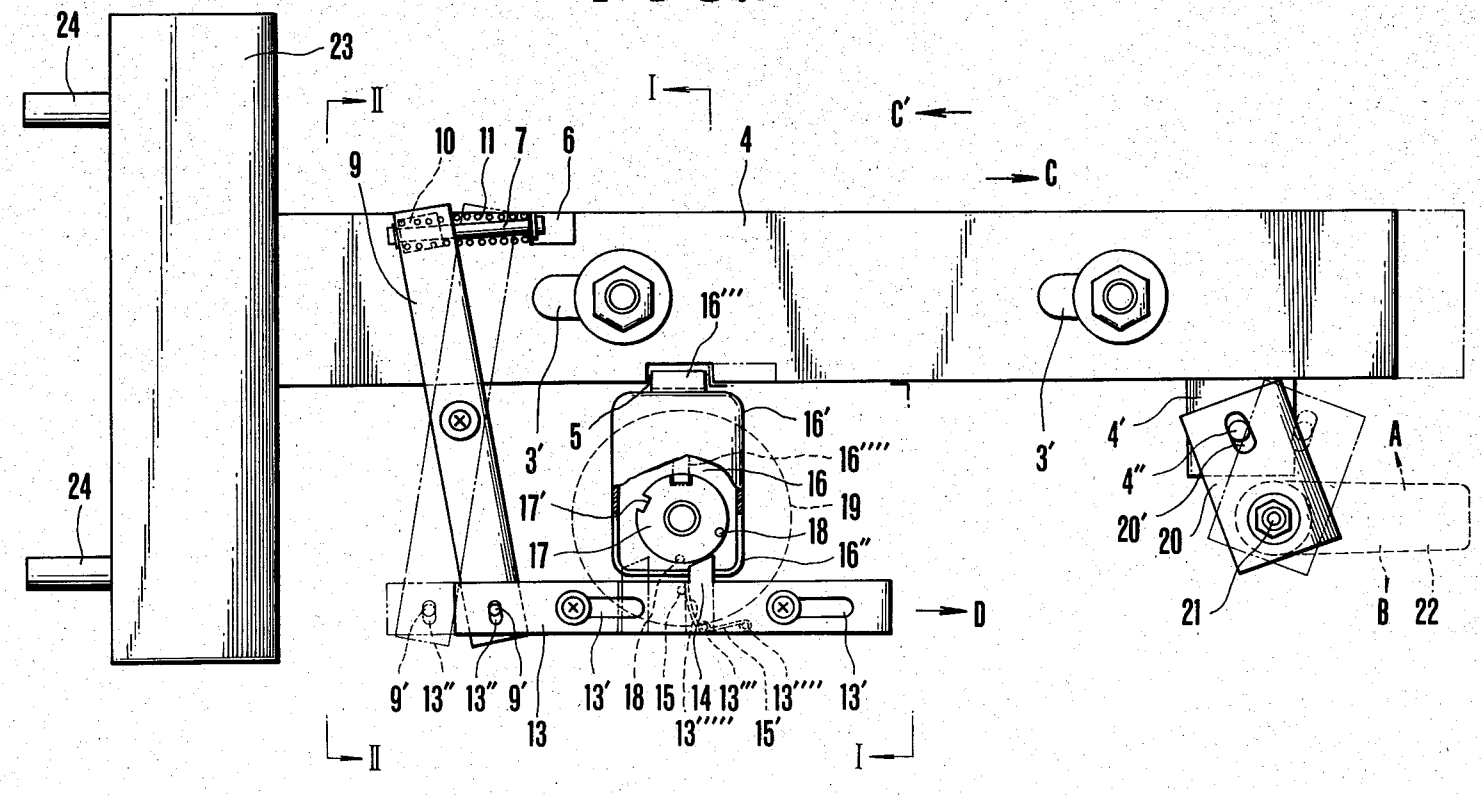
FIG. 2 is a front view of an essential part of the locking device, shown in an enlarged scale.
Figure 3:
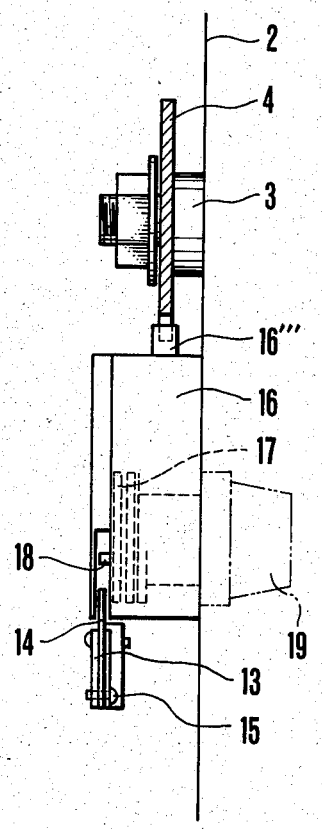
FIG. 3 is a vertical sectional view of the locking device taken in line I—I in FIG. 2.

On the other hand, the lever plate 9 is operatively connected to an actuating plate 13 at the lower end part thereof, said actuating plate 13 being displaceably supported by means of a pair of support rods 12 which are inserted through elongated holes 13'. A ratch member 14 is turnably supported on the actuating plate 13 in such a manner as to normally turn in the counterclockwise direction as seen in FIG. 2 under the influence of resilient force given by a leaf spring 15' and to inhibit excessive turning movement of the ratch member 14 in the counterclockwise direction a pin 15 is projected on the actuating plate 13.

Operative connection of the lever plate to the actuating plate 13 is effected by means of a combination of a projection 9' on the lever plate 9 and an elongated guide hole 13'' on the actuating plate 13 through which said projection 9' is inserted. The leaf spring 15' is disposed by the actuating plate 13 in such a manner that the central part is wound about a pin 13''', the righthand end part as seen in the drawing is anchored at a pin 13'''' and the lefthand end part is engaged to the rear surface of the ratch member 14.

To allow the ratch member 14 turnably supported by the actuating plate 13 to project freely, a part 16'' of the side wall constituting a lock box 16' is cut out, and a numbering lock 16 is housed in the lock box 16'. The numbering lock 16 includes a plurality of tumblers 17 by means of which unlocking numbers are determined for the locking device and among them the tumbler having a number to be first set is fitted with a pin 18 at the lower end part which is adapted to serve as an engagement projection. In the drawing reference numeral 16''' designates a locking bar for the numbering lock 16, and reference numeral 16'''' is an engagement rod adapted to be vertically displaced to come in engagement with an engagement recess 17' formed on the tumbler 17. Further, reference numeral 19 designates a dial for rotating the tumblers 17, said dial being disposed outwardly of the door 2.

The movable plate 4 has a connecting member 4' fixedly secured thereto and a joint pin 4'' is projected on said connecting member 4' so that it is fitted through an elongate guide hole 20' on a connecting plate 20. A rotary shaft 21 is fixed to the lower end part of the connecting plate 20 and extends outwardly of the door 2 so that a handle 22 is attached to the outermost end part of said rotary shaft 21.

At the lefthand end part of the movable plate 4 is disposed a locking bar 23 fixedly secured thereto and a pair of locking rods 24 extend in the leftward direction from locking bar 23 to enter into locking holes 25 on the safe 1. Thus, locking or unlocking is effected by leftward or rightward movement of the movable plate 4.

In the illustrated embodiment the locking holes 25 are located on the righthand inner wall of the safe 1 as seen in FIG. 1 but the present invention should not be limited only to this. Alternatively, they may be located on the lefthand inner wall, the top or the bottom of the safe and it should of course be understood that the direction of extension of the locking rods 24 are determined depending on where the locking holes are located.

Operation of the locking mechanism according to the present invention will be described below.

In order to open the door 2 from the safe 1, the dial 19 is rotated in specified directions by a predetermined number of revolutions until each of the tumblers 17 assumes the position corresponding to the predetermined locking number (combination). Thus, the locking bar 16''' of the numbering lock 16 can be drawn downward, with the engagement rod 16'''' coming in engagement to the engagement recess 17' on the tumbler. As the handle 22 is actuated in the direction as identified with reference letter B in FIG. 2, the movable plate 4 is caused to move rightward (in the direction as identified with reference letter C) whereby the locking rods 24 are disconnected from the locking holes 25. Now, the door 2 is ready to be opened. At this time the locking bar 16''' of the numbering lock 16 is kept disconnected from the engagement recess 5 on the movable plate 4 and there is no operative connection between the locking bar 16''' of the numbering lock 16 and the movable plate 4, so that movable plate 4 is ready to move. Thus, by rotating the handle 22 turns the connecting plate 20 in the clockwise or counterclockwise direction, and the movable plate 4 is caused to move in the rightward or leftward direction a distance defined by the length of the elongated holes 3' and 3'.

When it is required to unlock the door 2, the handle 22 is rotated and thereby the movable plate 4 operatively connected thereto via the connecting plate 20 is displaced in the rightward direction whereby the lever plate 9 operatively connected to the movable plate 4 is caused to turn in the clockwise direction and the actuating plate 13 operatively connected to the lever plate 9 is then displaced in the leftward direction. This causes the ratch member 14 turnably supported by the side of the actuating plate 13 to normally turn in the counterclockwise direction. Ratch member 14, under the influence of resilient force of the leaf spring 15', engages with the pin 18 on the lower part of the tumbler 17 which is adapted to be first set. This tumbler is one of a plurality of tumblers 17 within numbering lock 16 by means of which unlocking numbers are determined for the numbering lock 16. As described above, the ratch member 14 is turnably supported by the side of the actuating plate 13 to normally turn in the counterclockwise direction under the influence of resilient force of the leaf spring 15'. Therefore after it comes in engagement to the pin 18, it is caused to turn in the clockwise direction. When it assumes the position located above the pin 18, it is turned in the counterclockwise direction until it abuts against the pin 15 on the actuating plate 13.

Next, description will be made below as to how the numbering lock 16 is brought in the locked state while the door 2 is closed.

The door 2 is closed by means of the handle 22 and then by turning the latter in the counterclockwise direction (in the direction as identified with reference letter A) the movable plate 4 with the locking bar 23 fixedly secured thereto is displaced in the leftward direction (in the direction as identified with reference letter C') with the aid of the connecting plate 20 whereby the lever plate 9 operatively connected to the movable plate 4 is caused to turn in the counterclockwise direction under the influence of resilient force of the coil spring 11 and the actuating plate 13 operatively connected to the lever plate 9 is displaced in the rightward direction (in the direction as identified with reference letter D).

At this moment the ratch member 14, turnably supported by the side of the actuating plate 13, is brought in engagement to the pin 18 at the lower part of the tumbler 17 adapted to be first set, one of the plural tumblers 17, while ratch is member 14 also inhibited from excessive turning movement in the counterclockwise direction by pin 15 on the actuating plate 13. Thus, as the tumbler 17 is thrusted by the ratch member 14, it will be pushed in the counterclockwise direction. However, because the locking bar 16''' of the numbering lock 16 abuts against the lower edge of the movable plate 4, tumbler 17 cannot be rotated in the counterclockwise direction. Since the movable plate 4 is operatively associated with the lever plate 9 by way of the slidable pin 7 and the coil spring 11, the movable plate 4 can be displaced in the leftward direction while compressing the coil spring 11 irrespective of how movement of the actuating plate 13 and of the lever plate 9 being inhibited. Thus, when the displacement of movable plate 4 causes engagement recess 5 formed on the lower edge of the movable plate 4 to be located in vertical alignment with the locking bar 16''' of the numbering lock 16, the locking bar 16''' is ready to enter the engagement recess 5.

Since the lever plate 9 is being urged in the counterclockwise direction under the influence of resilient force of the coil spring 11, the actuating plate 13 operatively connected to the lever plate 9 is caused to move in the rightward direction (Direction D). Whereby the pin 18 on the tumbler 17 is being thrusted by means of the ratch member 14 on the actuating plate 13 the tumbler 17 is rotated in the counterclockwise direction and the locking bar 16''' is displaced away from the engagement recess 17'. As a result the locking bar 16''' of the numbering lock 16 is projected above the lock box 16' until it is brought in engagement to the engagement recess 5 on the movable plate 4. Thus, the door 2 of the safe becomes locked.

Since the tumblers 17 designed to determine unlocking numbers for the numbering lock 16 have been rotated in that way and thereby the predetermined unlocking numbers for the numbering lock 16 have been already brought out of order, it results that the numbering lock is kept in the locked state.

As will be readily understood from the above description, the locking device according to the present invention assures that a numbering lock is automatically brought in the locked state merely by projecting a locking bar with the aid of a handle after the door is closed on the safe 1. Accordingly, there is no necessity for bringing the numbering lock in the locked state by rotating a dial on the numbering lock by a number of revolutions more than specified one that is case with the conventional locking device. As a result a period of time required for closing and locking a door on a safe or the like apparatus can be substantially reduced.

Another advantageous feature of the locking device of the invention is that there is reliably prevented an occurrence of such a trouble as the case where the numbering lock fails to be locked because an operator unintentionally forgets rotation of the dial by a number of revolutions more than specified one after the door is closed. Thus, high safety is assured for a safe or the like apparatus. Another advantageous feature of the locking device of the invention is that the numbering lock can be brought in the locked state merely by operating an handle even in case where an emergency takes place.

While the present invention has been described above only with respect to a preferred embodiment thereof, it should of course be understood that it should not be limited only to this but various changes or modifications may be made without any departure from the spirit and scope of the invention.

What is claimed is:

1. A locking device for a door turnably mounted on a safe or the like comprising:

a numbering lock with a case having a cutout portion;

a movable plate for locking the door and having an engagement recess;

a locking bar fitted at one end of said plate and engaging said recess;

at least one locking rod extending from said bar to be inserted into a corresponding hole on the safe or the like during locking;

a lever plate operatively connected to said moveable plate;

a slidable pin, and spring means disposed on said slidable pin for connecting said moveable plate to said lever plate, an actuating plate connected to said lever plate for movement with said lever plate within a specified extent;

a ratch member turnably supported on said actuating plate so that said ratch member moves with said actuating plate and projects into said cutout portion;

a plurality of tumblers for determining unlocking numbers for the numbering lock; and engagement means provided on one of said tumblers for engaging with said ratch member wherein when said locking bar engages with said engagement recess, said ratch member causes at least one of said tumblers to rotate thereby locking the safe.

2. A locking device as defined in claim 1, wherein the movable plate is movably disposed along the inner wall of the door in a horizontal posture.

3. A locking device as defined in claim 1, further comprising a support rod which is located at the middle part of the lever plate, the lever plate being turnably supported about said support rod.

4. A locking device as defined in claim 1, wherein an extent of movement of both the movable plate and the actuating plate is defined by means of elongated holes.

5. A locking device as defined in claim 1, wherein the engagement means on the tumbler is a pin projecting on the engagement means.

6. A locking device as defined in claim 1, further comprising a pin provided on the actuating plate to inhibit excessive turning movement of the ratch member.

7. A locking device as defined in claim 1, further comprising a leaf spring biasing the ratch member so that the ratch member is turnable in the direction toward the lever plate under the influence of resilient force of said leaf spring.

8. A safe comprising:

a locking rod for engaging with holes in the safe to lock a door of the safe in a closed position, said locking rod being in a first position when locked and a second position when unlocked;

a movable plate, rigidly coupled to said locking rod so that said movable plate is in a first position when locked and a second position when unlocked and having an engaging recess located thereupon;

a numbering lock;

locking bar means, within said numbering lock, for in a first position engaging with said engaging recess thus immobilizing said movable plate in said first position to thereby lock the safe, and for in a second position allowing free movement of said movable plate;

tumbler means, within said numbering lock, for biasing said locking bar means toward said engaging recess when in a lock position, thereby causing said locking bar means to engage with said engaging recess only when said locking bar means and said engaging recess are coextensively located; and ratch means for springably biasing said tumbler means in a locking mode to cause said tumbler means to rotate when said door is closed thereby locking said numbering lock.

9. A safe as in claim 8 further comprising:

a lever plate operatively connected to said movable plate;

spring and pin means for springably coupling said lever plate to said movable plate; and an actuating plate operatively connected to said lever plate, said ratch member being springably located on said actuating plate.

10. A safe as in claim 9 further comprising leaf spring means for springably attaching said ratch means to said actuating plate.

11. A device as in claim 10 wherein said further comprising a pin mounted next to said ratch means for inhibit excessive rotation of said ratch means.

12. A device as in claim 9 further comprising:

a locking notch rigidly connected to said locking bar within said numbering lock; and an engaging recess located on one of said tumblers wherein said tumblers cannot be rotated when said locking notch is engaged in said engaging recess.

13. A safe as in claim 12 wherein said tumblers include an engaging pin for engaging said ratch means.

14. A safe as in claim 8 wherein said tumbler means can freely rotate when said locking bar means is engaged with said engaging means, and cannot rotate when said locking bar means is not engaged with said engaging means.

15. A safe as in claim 14 wherein biasing of said tumbler means when said locking bar means is not engaged with said engaging means causes said locking bar means to be based toward said engaging means.

16. A locking device for locking the door of a safe in a closed position, comprising:

locking rod means for locking said door in a closed position and unlocking said door in an open position;

movable plate means rigidly attached to said locking means for moving when said locking rod means locks and unlocks said door, with an engaging recess located on said movable plate means;

numbering lock means for controlling ingress to said safe;

locking bar means, controlled by said numbering lock means, for engaging with said engaging recess and thereby terminating any motion of said movable plate means and said locking means;

tumbler means, within said numbering lock means, for biasing said locking bar means toward said engaging recess in a locking mode so that said locking bar means engages with said engaging recess when the two are coextensively located, said tumbler means being freely rotatable when said locking bar means is engaged with said engaging means and rotation of said tumbler means being constricted when said locking bar means is not engaged with said engaging recess, rotation of said tumbler means causing said locking bar means to be biased toward said engaging means;

a lever plate attached to said movable plate means;

a spring and pin means for springably connecting said lever plate to said movable plate;

an actuating plate attached to said lever plate;

ratch means springably connected to said actuating plate and located so that a portion of said ratch means extends into said numbering lock means for biasing said tumbler means; and engaging means on said tumbler means for engaging with said ratch means wherein said tumbler means is caused to rotate by said ratch means when said tumbler means becomes freely rotatable, thereby locking said numbering lock means.

* * * * *